United States Patent [19]

Potter et al.

[11] Patent Number: 4,955,399

[45] Date of Patent: Sep. 11, 1990

[54] SMOKING ARTICLE

[75] Inventors: Dennis L. Potter, Kernersville; Mark L. Raker, Clemmons; Henry T. Ridings, Lewisville; Andrew J. Sensabaugh, Jr., Winston-Salem; Amos E. Westmoreland, Winston-Salem; Woods, Donna K., Winston-Salem; Chandra K. Banerjee, Pfafftown, all of N.C.

[73] Assignee: R. J. Reynolds Tobacco Company, Winston-Salem, N.C.

[21] Appl. No.: 277,730

[22] Filed: Nov. 30, 1988

[51] Int. Cl.[5] ..... A24D 1/00; A24D 1/02; A24D 1/18

[52] U.S. Cl. ..... 131/359; 131/271; 131/273; 131/194; 131/195

[58] Field of Search ..... 131/359, 369, 270, 271, 131/273, 194, 195, 360

[56] References Cited

U.S. PATENT DOCUMENTS

| | | |
|---|---|---|
| 2,104,266 | 1/1938 | McCormick . |
| 3,258,015 | 6/1966 | Ellis et al. . |
| 3,683,936 | 8/1972 | O'Neil, Jr. . |
| 3,766,079 | 10/1973 | Jackman . |
| 3,875,083 | 4/1975 | Murtaugh . |
| 3,924,603 | 12/1975 | Chapin . |
| 3,968,048 | 7/1976 | Bolan . |
| 4,058,474 | 11/1977 | Keyes et al. . |
| 4,067,313 | 1/1978 | Donnelly . |
| 4,079,742 | 3/1978 | Rainer et al. . |
| 4,149,548 | 4/1979 | Bradshaw . |
| 4,206,068 | 6/1980 | Davis . |
| 4,284,089 | 8/1981 | Ray . |
| 4,338,098 | 7/1982 | Yamaji . |
| 4,393,884 | 7/1983 | Jacobs . |
| 4,574,051 | 3/1986 | Matthews et al. . |
| 4,708,151 | 11/1987 | Shelar . |
| 4,714,082 | 12/1987 | Banerjee et al. . |
| 4,756,318 | 7/1988 | Clearman et al. . |
| 4,774,971 | 10/1988 | Vieten . |

FOREIGN PATENT DOCUMENTS

| | | |
|---|---|---|
| 276250 | 6/1967 | Australia . |
| 174645 | 3/1986 | European Pat. Off. . |
| 212234 | 3/1987 | European Pat. Off. . |
| 8602528 | 5/1986 | World Int. Prop. O. . |

*Primary Examiner*—V. Millin

[57] ABSTRACT

A cigarette provides tobacco flavor by heating tobacco, but not burning tobacco or any other material. A heat source which includes a metal oxide (e.g., calcium oxide), an anhydrous metal sulfate (e.g., magnesium sulfate), an inorganic salt and a sugar, generates heat upon contact of water therewith. The heat produced by the heat source heats tobacco in a heat exchange relationship therewith. Flavors volatilize from the tobacco and are drawn into the mouth of the user of the cigarette. Typical heat sources heat the tobacco to a temperature within 70° C. to 200° C. for 4 to 8 minutes.

84 Claims, 1 Drawing Sheet

SMOKING ARTICLE

BACKGROUND OF THE INVENTION

The present invention relates to cigarettes and other smoking articles such as cigars, pipes, and the like, and in particular, to smoking articles which employ a relatively low temperature heat source to heat tobacco to produce a tobacco flavor or tobacco-flavored aerosol.

Preferred smoking articles of the invention are capable of providing the user with the sensations of smoking (e.g., smoking taste, feel, satisfaction, pleasure, and the like), without burning tobacco or any other material, without producing sidestream smoke or odor, and without producing combustion products such as carbon monoxide. As used herein, the term "smoking article" includes cigarettes, cigars, pipes, and the like, which use tobacco in various forms.

Many smoking articles have been proposed through the years as improvements upon, or alternatives to, smoking products which burn tobacco.

Many tobacco substitute smoking materials have been proposed, and a substantial listing of such materials can be found in U.S. Pat. No. 4,079,742 to Rainer et al. Tobacco substitute smoking materials having the tradenames Cytrel and NSM were introduced in Europe during the 1970's as partial tobacco replacements, but did not realize any long-term commercial success.

Numerous references have proposed smoking articles which generate flavored vapor and/or visible aerosol. Most of such articles have employed a combustible fuel source to provide an aerosol and/or to heat an aerosol. See, for example, the background art cited in U.S. Pat. No. 4,714,082 to Banerjee et al.

However, despite decades of interest and effort, no one had successfully developed a smoking article which provided the sensations associated with cigarette or pipe smoking, without delivering considerable quantities of incomplete combustion and pyrolysis products.

Recently, however, in European Patent Publication Nos. 174,645 and 212,234, and U.S. Pat. Nos. 4,708,151, 4,714,082, and 4,756,318, assigned to R. J. Reynolds Tobacco Co., there are described smoking articles which are capable of providing the sensations associated with cigarette and pipe smoking, without burning tobacco or delivering considerable quantities of incomplete combustion products. Such articles rely on the combustion of a fuel element for heat generation, resulting in the production of some combustion products.

Over the years, there have been proposed numerous smoking products which utilize various forms of energy to vaporize or heat tobacco, or attempt to provide the sensations of cigarette or pipe smoking without burning any substance. For example, U.S. Pat. No. 2,104,266 to McCormick proposed an article having a pipe bowl or cigarette holder which included an electrical resistance coil. Prior to use of the article, the pipe bowl was filled with tobacco or the holder was fitted with a cigarette. Current then was passed through the resistance coil. Heat produced by the resistance coil was transmitted to the tobacco in the bowl or holder, resulting in the volatilization of various ingredients from the tobacco.

U.S. Pat. No. 3,258,015 and Australian Patent No. 276,250 to Ellis et al proposed, among other embodiments, a smoking article having cut or shredded tobacco mixed with a pyrophorous material such as finely divided aluminum hydride, boron hydride, calcium oxide or fully activated molecular sieves. In use, one end of the article was dipped in water, causing the pyrophorous material to generate heat which reportedly heated the tobacco to a temperature between 200° C. and 400° C. to cause the tobacco to release volatilizable materials. Ellis et al also proposed a smoking article including cut or shredded tobacco separated from a sealed pyrophorous material such as finely divided metallic particles. In use, the metallic particles were exposed to air to generate heat which reportedly heated the tobacco to a temperature between 200° C. and 400° C. to release aerosol forming materials from the tobacco.

PCT Publication No. WO 86/02528 to Nilsson et al proposed an article similar to that described by McCormick. Nilsson et al proposed an article for releasing volatiles from a tobacco material which had been treated with an aqueous solution of sodium carbonate. The article resembled a cigarette holder and reportedly included a battery operated heating coil to heat an untipped cigarette inserted therein. Air drawn through the device reportedly was subjected to elevated temperatures below the combustion temperature of tobacco and reportedly liberated tobacco flavors from the treated tobacco contained therein. Nilsson et al also proposed an alternate source of heat whereby two liquids were mixed to produce heat.

Despite many years of interest and effort, none of the foregoing non-combustion articles has ever realized any significant commercial success, and it is believed that none has ever been widely marketed. Moreover, it is believed that none of the foregoing noncombustion articles is capable of providing the user with the sensations of cigarette or pipe smoking.

Thus, it would be desirable to provide a smoking article which can provide many of the sensations of cigarette or pipe smoking, which does not burn tobacco or other material, and which does not produce any combustion products.

SUMMARY OF THE INVENTION

The present invention relates to cigarettes and other smoking articles which normally employ a non-combustion heat source for heating tobacco to provide a tobacco flavor and other sensations of smoking to the user thereof. Smoking articles of the present invention do not burn tobacco or any other materials, and hence do not produce any combustion or pyrolysis products including carbon monoxide, and do not produce any sidestream smoke or odor. Preferred smoking articles of the present invention produce controlled amounts of volatilized tobacco flavors and other substances which do not volatilize to any significant degree under ambient conditions, and such volatilized substances can be provided throughout each puff, for at least 6 to 10 puffs, the normal number of puffs for a typical cigarette.

More particularly, the present invention relates to cigarettes and other smoking articles having a low temperature heat source which generates heat as a result of one or more exothermic interactions between the components thereof. The tobacco, which can be in a processed form, is positioned physically separate from, and in a heat exchange relationship with, the heat source. By "physically separate" is meant that the tobacco used for providing flavor is not mixed with, or is not a part of, the heat source.

The heat source includes at least one chemical agent which is capable of interacting exothermically with a second chemical agent upon contact and/or suitable activation. Preferably, the heat source includes more than one agent which interacts with the second agent. Preferably, the chemical agents do not require environmental (i.e., atmospheric) oxygen to generate heat. The chemical agents can be incorporated or introduced into the heat source in a variety of ways. For example, the agents can be mixed together, and the exothermic interaction therebetween can be initiated upon the introduction of a catalyst or initiator thereto. Alternatively, the various agents can be incorporated into the heat source physically separate from one another, and exothermic interaction therebetween is provided by initiating contact of the various agents. In yet another regard, agents within the heat source can have a second agent introduced into the heat source to provide the generation of heat.

The heat source also normally includes (i) a dispersing agent to reduce the concentration of the aforementioned chemical agents and help control (i.e., limit) the rate of tinteraction of the chemical agents, and/or (ii) a phase change material which normally undergoes a reversible phase change during heat generation from a solid state to a liquid state, and back again, to initially absorb heat generated by the chemical interactants and to release that heat during the later stages of heat generation. The dispersing agent and/or the phase change material help (i) reduce the maximum temperature of the heat source and the tobacco, and (ii) prolong the life of the heat source by limiting the rate of interaction of the chemical agents, in the case of the dispersing agent, and by absorbing and releasing heat, in the case of the phase change material.

A preferred heat source is a mixture of solid components which provide the desired heat delivery upon interaction of certain components thereof with a liquid such as water. For example, a solid mixture of calcium oxide, anhydrous magnesium sulfate, malic acid, dextrose and sodium chloride can be contacted with liquid water to generate heat. Heat is generated by the hydration of the magnesium sulfate, as well as by the malic acid catalyzed reaction of water and calcium oxide to yield calcium hydroxide. The dextrose undergoes a phase change from solid to liquid as the exothermic chemical interactions occur, thus absorbing energy. This absorbed energy is released at a later time when the heat generated by the chemical interactions diminish and the dextrose re-solidifies. The sodium chloride is employed as a dispersing agent in an amount sufficient to disperse the various components of the heat source to provide a controlled interaction of components over time.

Another preferred heat source is a mixture of finely divided aluminum metal and granular sodium nitrite which can be contacted with an aqueous solution of sodium hydroxide to generate heat. Heat is generated by reaction of the aluminum metal with the sodium hydroxide and water to yield sodium aluminate and hydrogen. The sodium nitrite reacts with the hydrogen to regenerate water and sodium hydroxide. As such, reactants for the heat generating reaction with the aluminum metal are regenerated such that a controlled generation of heat is provided over time.

Preferred heat sources generate relatively large amounts of heat to rapidly heat at least a portion of the tobacco to a temperature sufficient to volatilize flavorful components from the tobacco. For example, preferred smoking articles employ a heat source capable of heating at least a portion of the tobacco to above about 70° C. within 20 seconds from the time that the heat source is activated. Preferred smoking articles employ heat sources which avoid excessive heating of the tobacco and maintain the tobacco within a desired temperature range for about 4 to about 8 minutes. For example, it is desirable that the tobacco of the smoking article not exceed 350° C., and more preferably not exceed 200° C. during the useful life of the smoking article. For the highly preferred smoking articles, the heat sources thereof heat the tobacco contained therein to a temperature range between about 70° C. and about 180° C., during the useful life of the smoking article.

The tobacco can be processed or otherwise treated so that the flavorful components thereof readily volatilize at those temperatures experienced during use. In addition, the tobacco can contain or carry a wide range of added flavors and aerosol forming substances which volatilize at those temperatures experienced during use. For example, depending upon the temperature generated by the heat source, the smoking article can yield, in addition to the flavorful volatile components of the tobacco, a flavor such as menthol, and/or a visible aerosol provided by an aerosol forming substance such as glycerin.

To use the smoking article of the invention, the user initiates the interaction between the components of the heat source, and heat is generated. The interaction of the components of the heat source provides sufficient heat to heat the tobacco, and tobacco flavors and other flavoring substances are volatilized from the tobacco. When the user draws on the smoking article, the volatilized substances pass through the smoking article and into the mouth of the user. As such, the user is provided with many of the flavors and pleasures associated with cigarette smoking without burning any materials.

The smoking articles of the present invention are described in greater detail in the accompanying drawings and in the detailed description of the invention which follows.

DETAILED DESCRIPTION OF THE PREFERRED EMBODIMENTS

Figure 1:
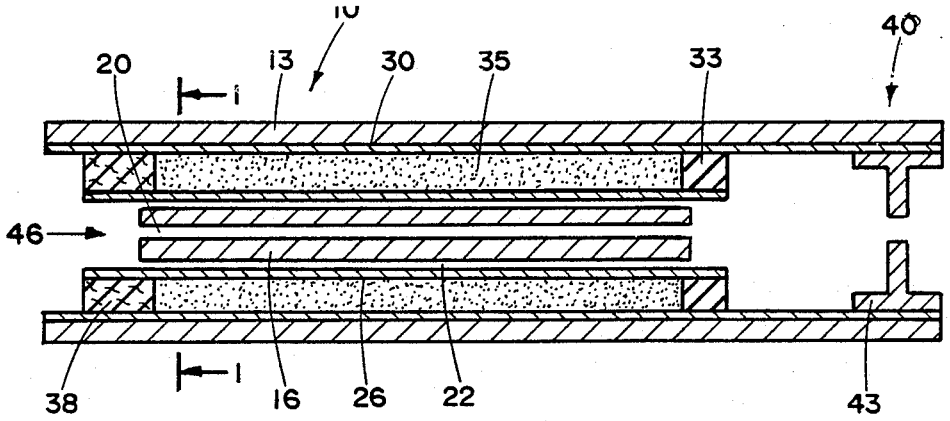
FIGS. 1 and 2 are longitudinal, sectional views of representative cigarette embodiments of this invention.

Referring to FIG. 1, cigarette 10 has an elongated, essentially cylindrical rod shape. Normally, the length of the cigarette ranges from about 70 to about 120 mm, and the circumference ranges from about 22 mm to about 30 mm.

The cigarette includes an outer member 13 which is a wrapper as well as a means for providing insulative properties. As shown in FIG. 1, the outer member 13 can be a layer of thermally insulative material, such as foamed polyestyrene sheet, foil lined paperboard, or the like. The outer member also can be a paper wrapper for the cigarette, or an insulative outer member can be wrapped further with a paper wrapper (not shown).

Within the outer member 13 is positioned a roll of tobacco which extends along a portion of the longitudinal axis of the cigarette. The tobacco can have a variety of configurations, and preferably has a high surface area to maximize contact with drawn air passing therethrough. As illustrated, the tobacco roll can be in the form of an extruded tobacco containing tube 16 which can have a plurality of passageways 20 and 22 extending longitudinally therethrough or therearound.

The tobacco 16 is located within tubular container 26 which can be formed from a heat resistant thermoplastic, metal, or the like. A second tubular container 30 surrounds the first tubular container 26, and optionally the length of the cigarette. The second tubular container can be formed from a heat resistant thermoplastic material, foil lined paperboard, or the like. A barrier 33 is positioned in the annular region between tubular containers 26 and 30 near the mouthend of tubular container 26, and provides an effective air seal between the two containers in that region. The barrier can be manufactured from thermoplastic material, or the like, and can be maintained in place between the tubular containers 26 and 30 by a tight friction fit, adhesive, or other such means.

A heat source 35 (discussed in greater detail hereinafter) is positioned in the annular region between tubular containers 26 and 30. An air permeable plug 38 is positioned opposite the mouthend of the cigarette between tubular containers 26 and 30, and acts to maintain the heat source 16 in the desired position and location about the tobacco 16. Plug 38 can be a fibrous material such as plasticized cellulose acetate, or a resilient open cell foam material. The cigarette 10 includes a mouthend region 40 which can include a filter element 43 or other suitable mouthend piece which provides a means for delivering flavor to the mouth of the user. The filter 43 can have a variety of configurations and can be manufactured from cellulose acetate tow, a pleated polypropylene web, molded polypropylene, or the like. Normally, the filter 43 has a low filtration efficiency. For example, the filter can have a molded form such as a baffled configuration (as shown in FIG. 1). In particular, it is most desirable that high amounts of the volatilized flavor components pass to the mouth of the user, and that low amounts of the flavor components be deposited onto the filter. The cigarette also includes an air inlet region 46, opposite the mouthend region 40, in order that drawn air can enter the cigarette.

Figure 2:
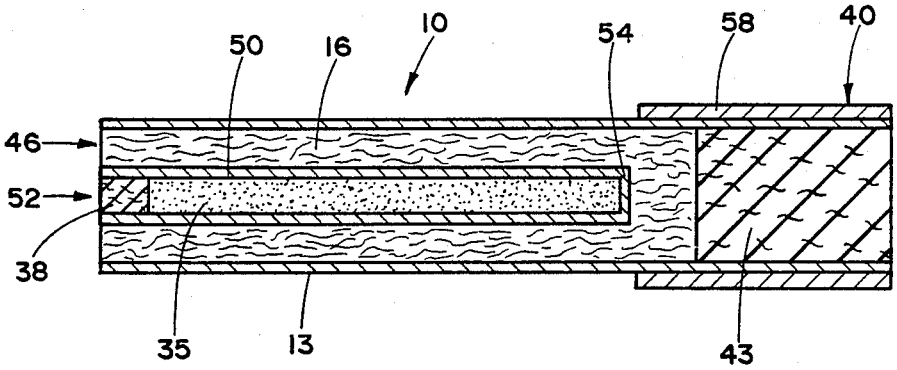

Referring to FIG. 2, cigarette 10 includes a roll or charge of tobacco wrapped in a generally tubular outer wrap 13 such as cigarette paper, thereby forming a tobacco rod. Preferably, the tobacco is in a cut filler form. In addition, the preferred tobacco filler is cased and top dressed with flavoring agents. Within the roll of tobacco filler is positioned a heat resistant cartridge 50 having an open end 52 near the air inlet region 46 of the cigarette, and a sealed end 54 toward the mouth end of the tobacco rod. The cartridge 50 preferably is composed of a heat conductive material, such as aluminum or other metallic material.

Within the cartridge is positioned heat source 35 (discussed in detail hereinafter). The heat source material 35 is maintained in place within the cartridge 50 by an air permeable pug 38 such as cellulose acetate. The resulting tobacco rod, having the heat source embedded therein, but such that the tobacco and heat source components are physically separate from one another, generally has a lengthy of about 50 to about 90 mm, and a circumference of about 22 mm to about 30 mm.

Filter element 43 is axially aligned with, and positioned in an end-to-end relationship with the tobacco rod. The filter element and tobacco rod are secured together using tipping paper 58. Normally, tipping paper has adhesive applied to the inner face thereof circumscribes the filter element and an adjacent region of the tobacco rod.

In use, the user initiates exothermic interaction of the heat source so that the heat source generates heat. For example, an effective amount of liquid water can be injected into the heat source so that the water can interact exothermically with certain components of the heat source. The resulting heat acts to warm the physically separate tobacco which is positioned in close proximity to the heat source so as to be in a heat exchange relationship therewith. The heat so supplied to the tobacco acts to volatilize flavorful components of the tobacco as well as flavorful components carried by the tobacco. The volatilized materials then are drawn to the mouth end region of the cigarette and into the user's mouth. As such, the user is provided with many of the flavors and pleasures associated with cigarette smoking without burning any materials. The heat source of this invention provides sufficient heat to volatilize flavorful components of the tobacco while maintaining the temperature of the tobacco within the desired temperature range. When heat generation is complete, the tobacco begins to cool and volatilization of flavorful components thereof decreases. The cigarette then is discarded or otherwise disposed of.

Heat sources of the smoking articles of the present invention generate heat as a result of one or more exothermic chemical interactions between components thereof, and not as a result of combustion of the components thereof. As used herein, the term "combustion" relates to the oxidation of a substance to yield heat and oxides of carbon. See, Baker, *Prog. Ener. Combust. Sci.*, Vol. 7, pp. 135–153 (1981). In addition, preferred non-combustion heat sources of this invention generate heat as a result of one or more interactions between components thereof without the necessity of the presence of any gaseous or environmental oxygen (i.e., in the absence of environmental oxygen).

Preferred heat sources generate heat rapidly upon activation of the components thereof. As such, heat is generated to warm the tobacco to a degree sufficient to volatilize an appropriate amount of flavorful components of the tobacco rapidly after the user has initiated use of the cigarette. Rapid heat generation also assures that sufficient volatilized tobacco flavor is provided during the early puffs. Typically, heat sources of the present invention include sufficient amounts of components which undergo exothermic interactions to heat at least a portion of the tobacco to a temperature in excess of 70° C., more preferably in excess of 80° C., within about 20 seconds, more preferably within about 10 seconds, from the time that the user has initiated use of the cigarette.

Preferred heat sources generate heat so that the tobacco is heated to within a desired temperature range during the useful life of the cigarette. For example, although it is desirable for the heat source to heat at least a portion of the tobacco to a temperature in excess of 70° C. very rapidly when use of the cigarette is initiated, it is also desirable that the tobacco experience a temperature of less than about 350° C., preferably less than about 200° C., during the 4 to 8 minute life of the cigarette. Thus, once the heat source achieves sufficient rapid heat generation to heat the tobacco to the desired minimum temperature, the heat source then generates heat sufficient to maintain the tobacco within a relatively narrow and well controlled temperature range for the remainder of the heat generation period. Typical temperature ranges for the 4 to 8 minute life of the cigarette are between about 70° C. and about 180° C., more preferably between about 80° C. and about 140° C., for most cigarettes of the present invention. Control of the maximum temperature exhibited by the heat source is desired in order to avoid thermal degradation and/or excessive, premature volatilization of the flavorful components of the tobacco as well as added flavor components which are carried by the tobacco.

The heat source includes components which interact exothermically with one another when contacted with one another or when suitably activated. Such components can be in physical contact (i.e, mixed together), and the exothermic interaction thereof can be activated by heat, contact with a catalyst or initiator, or the like. Alternatively, the components can be maintained physically separate from one another, and the exothermic interaction can be initiated by contact of the components, often in the presence of a suitable catalyst or initiator.

Highly preferred interactant materials are materials capable of reacting exothermically with water. Examples of such reactants are the metal oxides which react with water to generate heat and yield metal hydroxides. Suitable metal oxides include calcium oxide, magnesium oxide, sodium oxide, and the like, as well as mixtures thereof. Other suitable interactant components include calcium hydride, calcium nitride, magnesium nitride, phosphorous pentaoxide, and the like. Such other reactants, although less preferred than the metal oxides, often can be employed in small amounts with the metal oxides in order to provide for a rapid initial production of heat.

Another highly preferred chemical interactant is one which is readily hydrated by water in an exothermic manner. Examples of such interactants are the anhydrous metal sulfates such as magnesium sulfate, aluminum sulfate, ferric chloride, magnesium chloride, and the like, as well as mixtures thereof. Other such interactants will be apparent to the skilled artisan.

Water can interact with preferred heat source components to generate heat. Other liquids such as the lower alcohols (e.g., ethanol) and the polyhydroxy alcohols (e.g., glycerin) as well as mixtures thereof with water can be used in certain circumstances. Contact of water with the other interactive components of the heat source can be achieved in a variety of ways. For example, the water can be injected into the heat source when activation of the heat source is desired. Alternatively, liquid water can be contained in a container separate, such as a rupturable capsule or microcapsule, from the other components of the heat source, and the container can be ruptured when contact of the water with the other heat source components is desired. Alternatively, water can be supplied to the remaining portion of the heat source in a controlled manner using a porous wick. In yet another example, water needed for the exothermic reaction thereof with interactive components can be supplied by a normally solid, fully hydrated salt (e.g., aluminum potassium sulfate dodecahydrate crystals) which is mixed with the metal oxide. The water can be released by the application of heat to the heat source (e.g., using a cigarette lighter) to conduct heat to the heat source, and which in turn initiates the disassociation of the water from the hydrated salt.

Catalysts or initiators, other than or in addition to water, can be employed to catalyze or initiate the chemical reaction of the components which react exothermically. For example, organic acids such as malic acid, palmatic acid, boric acid, or the like, can be mixed with water and/or calcium oxide in an amount sufficient to catalyze the exothermic reaction thereof to produce calcium hydroxide. When the catalyst or initiator is mixed with the solid components of the heat source, it is preferred that the catalyst or initiator be in a solid form.

The heat source also includes a dispersing agent to provide a physical spacing of the interactant components, particularly when at least one of the interactant materials has a solid form. Preferred dispersing agents are essentially inert with respect to the components which interact exothermically. Preferably, the dispersing agent is employed in a normally solid, granular form in order to (i) maintain the reactant components in a spaced apart relationship, and (ii) allow gases such as water vapor to flow through and escape from the heat source during the heat generation period. Examples of dispersing agents are inorganic salts such as sodium chloride, potassium chloride and anhydrous sodium sulfate; inorganic materials such as finely ground alumina and silica; carbonaceous materials such as finely ground graphite, activated carbons and powdered charcoal; and the like. Generally, the normally solid dispersing agent ranges from a fine powder to a coarse grain in size; and the particle size of the dispersing agent can affect the rate of interaction of the heat generating components, and therefore the temperature and longevity of the interaction. When water is employed as one of the chemical interactants and the dispersing agent is a water soluble inorganic salt such as sodium chloride, it is desirable that the amount of water and water soluble dispersing agent be such that a majority of the salt maintains its crystalline form.

The heat source preferably includes a phase change or heat exchanging material. Examples of such materials are sugars such as dextrose, sucrose, and the like, which change from a solid to a liquid and back again within the temperature range achieved by the heat source during use. Other phase change agents include selected waxes or mixtures of waxes, and inorganic materials such as magnesium chloride. Such materials absorb heat as the interactant components interact exothermically so that the maximum temperature exhibited by the heat source is controlled. In particular, the sugars undergo a phase change from solid to liquid upon application of heat thereto, and heat is absorbed. However, after the exothermic chemical interaction of the interactive components is nearly complete and the generation of heat thereby decreases, the heat absorbed by the phase change material can be released (i.e., the phase change material changes from a liquid to a solid) thereby extending the useful life of the cigarette. Phase change materials such as waxes, which have a viscous liquid form when heated, can act as dispersing agents also.

The relative amounts of the various components of the heat source can vary, and often is dependent upon factors such as the minimum and maximum amounts of heat desired, the time period over which heat generation is desired, and the like. For example, when water is contacted with a mixture of a metal oxide and an anhydrous metal sulfate, it is desirable that the amount of water be sufficient to fully hydrate the anhydrous metal sulfate and react stoichiometrically with the metal oxide. Additionally, it is desirable that the amount of metal oxide and metal sulfate be sufficient to generate enough heat upon interaction with water to sufficiently heat the tobacco to effect volatilization of flavorful tobacco components during the life of the cigarette. Normally, the solid portion of such a heat source weighs less than 2 grams, and generally weighs from about 0.5 g to about 1.5 g. Normally, larger aluminum or magnesium particles provide for a chemical reaction which generates a lower initial amount of heat but which maintains a moderately high level of heat generation for a relatively long period of time. Additionally, the use of relatively concentrated aqueous sodium hydroxide solution provides for a reaction which generates a relatively high initial temperature. However, the addition of a buffer, such as potassium, to the reaction mixture delays initial temperature generation even though contact of the interactive components has been made (e.g., even though the sodium hydroxide solution has been added to an aluminum and a sodium nitrate mixture). Alternatively, the addition of a base such as granular barium hydroxide or calcium hydroxide to the solid portion of the heat source provides for a reaction mixture which does not readily generate heat when stored, but which generates a very high amount of initial heat when contacted with an aqueous sodium hydroxide solution of another suitable initiator such as heat.

Another preferred heat source can be provided by mixing granular aluminum and/or magnesium metal with granular sodium nitrite and/or sodium nitrate; and the resulting mixture can be contacted with an aqueous solution of sodium hydroxide to generate heat. Typically, the solid portion of the heat source weighs from about 50 mg to about 300 mg. The solid portion of the heat source normally is contacted with about 0.05 ml to about 0.5 ml of an aqueous solution of sodium hydroxide having a concentration of sodium hydroxide of about 5 to about 50 weight percent.

Normally, larger aluminum or magnesium particles provide for a chemical reaction which generates a lower initial amount of heat but which maintains a moderately high level of heat generation for a relatively long period of time. Additionally, the use of relatively concentrated aqueous sodium hdyroxide solution provides for a reaction which generates a relatively high initial temperature. However, the addition of a buffer, such as potassium, to the reaction mixture delays initial temperature generation even though contact of the interactive components has been made (e.g., even though the sodium hydroxide solution has been added to an aluminum and sodium nitrate mixture). Alternatively, the addition of a base such as granular barium hydroxide or calcium hydroxide to the solid portion of the heat source provides for a reaction mixture which does not readily generate heat when stored, but which generates a very high amount of initial heat when contacted with an a aqueous sodium hydroxide solution of another suitable initiator such as heat.

The roll or charge of tobacco can be employed as cut filler, although other forms of tobacco can be employed. For example, the tobacco can be employed as strands or shreds of tobacco laminae, reconstituted tobacco, volume expanded tobacco, processed tobacco stems, or blends thereof. Extruded tobacco materials and other forms of tobacco, such as tobacco extracts, tobacco dust, or the like, also can be employed. Tobacco extracts include tobacco essences, tobacco aroma oils, spray dried tobacco extracts, freeze dried extracts, and the like. Processed tobaccos, such as tobaccos treated with sodium bicarbonate or potassium carbonate, which readily release the flavorful components thereof upon the application of heat thereto are particularly desirable. Normally, the weight of the tobacco within the cigarette ranges from about 0.2 g to about 1 g.

The tobacco can be employed with flavoring agents such as menthol, vanillin, chocolate, licorice, cinnamic aldehyde, maltol, genaniol, methyl salicylate, acetyl-2-acetyl pyrazine, and the like; as well as tobacco flavor modifiers such as levulinic acid. Such flavoring agents can be carried by the tobacco or positioned elsewhere within the smoking article (e.g., in a separate substrate located in a heat exchange relationship with the heat exchange relationship with the heat source or within the filter). If desired, substances which vaporize and yield visible aerosols can be incorporated into the smoking article in a heat exchange relationship with the heat source. For example, an effective amount of glycerin can be carried by the tobacco.

The following examples are provided in order to further illustrate various embodiments of the invention but should not be construed as limiting the scope thereof. Unless otherwise noted, all parts and percentages are by weight.

EXAMPLE 1

A cigarette substantially as shown in FIG. 1 was prepared as follows:

A. Heat Source Preparation

The heat source was provided by intimately mixing 36.8 parts granular calcium oxide, 10.3 parts granular anhydrous magnesium sulfate, 5.9 parts malic acid, 22 parts powdered dextrose and 25 parts granular sodium chloride.

B. Tobacco Preparation

A dry blend of 34.2 parts flue-cured tobacco dust, 34.2 parts of a Burley tobacco spray dried water extract, 8.2 parts potassium carbonate, and 1.4 parts of a 1:1 xanthan gum and locust bean gum binding agent was fed continuously into one feed zone of a Werner and Pfleiderer Continua 37 27:1 L/D twin screw extruder. Into a second feed zone of the extruder was fed continuously enough water to provide 22 parts of water to the extruded mixture. The temperature within the barrel of the extruder was maintained at about 50° C. to about 75° C. during extrusion.

Figure 1A:
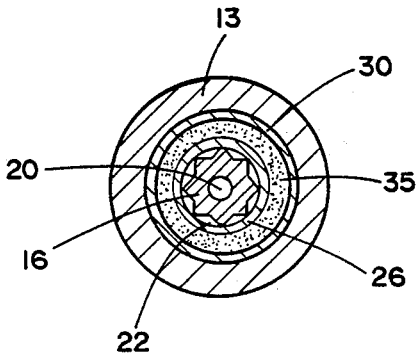
FIG. 1A is a cross sectional view of the embodiment shown in FIG. 1 taken along lines 1—1 in FIG. 1.

The extruder die had an orifice of a shape sufficient to provide a change of tobacco having the shape of the tube shown in FIG. 1A. The tobacco tube exiting the die had an outer surface having 16 sides (when viewed cross-sectionally), a maximum outer diameter of 4 mm, a minimum outer diameter of 3.5 mm, and a circular passageway (when viewed cross-sectionally) having a diameter of 1 mm.

The continuous tobacco tube was dried to a moisture content of 12.5 percent, and cut to a length of 40 mm. The length of extruded tobacco tube so provided had a weight of 0.32 g.

C. Assembly of the Cigarette

Into a polypropylene tube of 65 mm length and 4.35 mm outer diameter was positioned the 40 mm length of extruded tobacco. The inner diameter of the polypropylene tube was such that the extruded tobacco tube was held in place by friction fit within the polypropylene tube.

One end of the polypropylene tube was fitted with a short tube manufactured from Delrin which is available from E. I. duPont de Nemours. The short tube had a length of 3 mm, an outer diameter of 7.7 mm, and an inner diameter very slightly greater than that of the polypropylene tube such that short tube friction fit snuggly over the polypropylene tube (i.e., an essentially air tight seal was provided).

A second polypropylene tube of 85 mm length and 8 mm outer diameter was positioned over the Delrin tube with one end flush with the end of the 65 mm polypropylene tube remote from the Delrin tube. The other end of the second polypropylene tube extended 20 mm beyond the first polypropylene tube and the Delrin tube. The inner diameter of the second polypropylene tube was such that it friction fit snuggly over the short Delrin tube (i.e., to provide an essentially air tight seal).

Into the annular region between the two polypropylene tubes and was charged 1.5 g of the previously described heat source components such that the heat source extended about 40 mm along the length of the article.

A 7 mm length of a cellulose acetate tube was positioned so as to fit between the first and second polypropylene tubes. The cellulose acetate tube was an air permeable material commercially available as SCS-1 from American Filtrona Corp.

A mouthend piece was a resilient, molded polypropylene baffled mouthpiece element having a diameter of 7.75 mm and a length of 5 mm. The mouthpiece element was friction fit at one extreme end of the cigarette and within polypropylene tube, and was thereby held in place.

The length of the article was circumscribed by a polystyrene foamed sheet having a thickness of about 0.8 mm, available as Roll Stock from Valcour, Inc.

The cigarette had an overall length of about 85 mm, an overall diameter of about 9.42 mm, a total weight of 3.0 g, and exhibited a draw resistance of 120 mm $H_2O$ pressure drop as determined using a FTS-300 pressure drop tester from Filtrona Corp.

D. Use of the Cigarette

Into the air inlet end of the cigarette, through the cellulose acetate tube and into the solid portion of the heat source, was inserted a small diameter tube. About 0.4 ml of the water was injected through the tube into the heat source about 2 mm from the short Delrin tube.

The heat source began to generate heat when the water was injected into the solid material. No combustion was observed. Within 7 seconds, the heat source reached 70° C. The cigarette maintained an average temperature of 103° C., as well as remained within a temperature range of 85° C. to 120° for more than 5 minutes.

The cigarette yielded tobacco flavor on all puffs for 10 puffs when drawn upon while the heat source was generating heat even though no visible aerosol was observed.

EXAMPLE 2

The following heat source was prepared:

A wax sold commercially as Paraflint by Parafilm Corp. was ground to a particle size of about 40 to about 60 mesh. About 10 g of the Paraflint wax particles then were mixed with 20 g of calcium oxide and 40 g anhydrous magnesium sulfate. The resulting solid mixture was pressed under 15,000 pounds pressure using a Carver Laboratory Press to a cylindrical pill having a diameter of 1 inch and a thickness of 14 cm. The pill then was ground into a coarse powder. About 1 g of the coarse powder was contacted with about 0.5 ml of water to generate heat.

EXAMPLE 3

The following heat source was prepared:

About 100 mg of aluminum metal powder having a size of −325 US mesh was mixed with 200 mg of ground sodium nitrate having a size of −200 US mesh. To about 75 mg of the aluminum/sodium nitrate mixture was added 0.1 ml of a 20 percent solution of sodium hydroxide in water. The heat source generated heat rapidly and reached a temperature of about 140° C. in less than 30 seconds. The heat source maintained a temperature above 100° C. but less than about 140° C. for about 7 minutes.

EXAMPLE 4

The following heat source was prepared:

About 50 mg of aluminum metal powder having a size of −200 US mesh was mixed with 150 mg of granular sodium nitrate. To the resulting mixture was added 0.3 ml of a 5 percent solution of sodium hydroxide in water. The heat source generated heat rapidly and reached a temperature of about 120° C. in about 14 seconds. The heat source maintained a temperature of about 120° C. for about 3.5 minutes, and a temperature of about 80° C. for about 5 minutes.

EXAMPLE 5

The following heat source was prepared:

About 5 g of granular calcium oxide was mixed with about 3.48 g of granular aluminum potassium sulfate dodecahydrate. About 0.5 g of the resulting mixture was mixed with 0.5 g calcium oxide and 0.5 g boric acid. The mixture was charged into a small test tube and remained at room temperature overnight. The following day, the test tube was heated with a flame of a cigarette lighter for about 2 seconds. The heat source generated heat rapidly to achieve a temperature of about 100° C., and maintained a temperature within the range of about 100° C. to about 135° C. for about 4 minutes.

EXAMPLE 6

The following heat source was prepared:

About 28 mg of aluminum metal powder having a size of −200 US mesh was mixed with 86 mg of granular sodium nitrate and 86 mg potassium bicarbonate in a glass tube. To the resulting mixture was added 0.3 ml of a 5 percent solution of sodium hydroxide in water. The temperature of the reactant mixture rose to about 50° C. in less than 1 minute and remained at about 50° C. for about 15 minutes. Then the reactant mixture began to generate heat such that the mixture exhibited a temperature in excess of 90° C. for a period from about 20 to about 30 minutes from the time that the sodium hydroxide solution was added to the aluminum, sodium nitrate and bicarbonate mixture. This example shows that the temperature of the initial temperature exhibited by the heat source can be controlled, and the components of the heat source can interact to generate heat at a later time.

EXAMPLE 7

The following heat source was prepared:

About 28 mg of aluminum metal powder having a size of −200 US mesh was mixed with 86 mg of granular sodium nitrate and 86 mg of a granular barium hydroxide in a glass tube. To the reaction mixture was introduced a flame from a cigarette lighter for about 3 seconds. The heat source generated heat rapidly and reached a temperature of about 320° C. in less than about 20 seconds. The heat source maintained a temperature in excess of about 100° C. for about 4 minutes.

What is claimed is:

1. A cigarette which does not burn tobacco comprising: (a) tobacco; and
(b) a physically separate, non-combustion heat source for heating but not burning the tobacco, and including
(i) a first chemical agent capable of interacting exothermically with a second chemical agent, and a third chemical agent capable of interacting exothermically with the first chemical agent, and
(ii) a dispersing agent for the first agent.

2. A cigarette which does not burn tobacco comprising:
(a) tobacco; and
(b) a physically separate, non-combustion heat source for heating but not burning the tobacco, and including
(i) a first chemical agent capable of interacting exothermically with a second chemical agent,
(ii) a dispersing agent for the first agent, and
(iii) a phase change material.

3. The cigarette of claim 2, wherein the heat source further includes a third chemical agent capable of interacting exothermically with the first chemical agent.

4. The cigarette of claim 3, wherein the tobacco is in extruded form.

5. The cigarette of claim 3, wherein the heat source is capable of heating at least a portion of the tobacco to a temperature in excess of about 70° C. within 20 seconds from the time that exothermic interaction of the chemical agents is initiated.

6. The smoking article of claim 1, 2 or 3, including a mouthend piece for delivering flavor volatilized by the heat source to the mouth of the user of the article.

7. The cigarette of claim 1 or 2, wherein the tobacco is in extruded form.

8. The cigarette of claim 1 or 2, wherein the dispersing agent has a granular form.

9. The cigarette of claim 1 or 2, wherein the heat source is capable of heating at least a portion of the tobacco to a temperature in excess of about 70° C. within 20 seconds from the time that exothermic interaction of the chemical agents is initiated.

10. The cigarette of claim 1 or 2, wherein the heat source is such that the tobacco is not heated to a temperature above about 350° C. during the life of the heat source.

11. The cigarette of claim 1 or 2, wherein the heat source is such that the tobacco is not heated to a temperature above about 180° C. during the life of the heat source.

12. A smoking article which does not burn tobacco comprising:
(a) tobacco; and
(b) a physically separate, non-combustion heat source for heating but not burning the tobacco, and including
(i) a first chemical agent capable of interacting exothermically with a second chemical agent, and a third chemical agent capable of interacting exothermically with the first chemical agent, and
(ii) a dispersing agent for the first agent.

13. The smoking article of claim 12, including a mouthend piece for delivering flavor volatilized by the heat source to the mouth of the user of the article.

14. A smoking article which does not burn tobacco comprising:
a tobacco; and
(b) a physically separate, non-combustion heat source for heating but not burning the tobacco, and including
(i) a first chemical agent capable of interacting exothermically with a second chemical agent,
(ii) a dispersing agent for the first agent, and
(iii) a phase change material.

15. The smoking article of claim 14, wherein the heat source further includes a third chemical agent capable of interacting exothermically with the first chemical agent.

16. The smoking article of claim 15, wherein the tobacco is in extruded form.

17. The smoking article of claim 12 or 14, wherein the tobacco is in extruded form.

18. The smoking article of claim 14, wherein the phase change material has a solid form prior to use of the article.

19. The smoking article of claim 12 or 14, wherein the dispersing agent has a granular form.

20. The smoking article of claim 12 or 14, wherein the heat source is capable of heating at least a portion of the tobacco to a temperature in excess of about 70° C within 20 seconds from the time that exothermic interaction of the chemical agents is initiated.

21. The smoking article of claim 12 or 14, wherein the heat source is capable of heating at least a portion of the tobacco to a temperature in excess of about 70° C. within 10 seconds from the time that exothermic interaction of the chemical agents is initiated.

22. The smoking article of claim 12 or 14, wherein the heat source is such that the tobacco is not heated to a temperature above about 350° C. during the life of the heat source.

23. The smoking article of claim 12 or 14, wherein the heat source is such that the tobacco is not heated to a temperature above about 180° C. during the life of the heat source.

24. A smoking article which does not burn tobacco comprising:
(a) tobacco; and
(b) a physically separate, non-combustion heat source for heating but not burning the tobacco, and including
(i) at least one chemical agent capable of interacting exothermically with water, and
(ii) a dispersing agent for the chemical agent.

25. The smoking article of claim 24, having the form of a cigarette.

26. The smoking article of claim 25, wherein the heat source further includes a phase change material.

27. The smoking article of claim 24 or 25, wherein the tobacco is in an extruded form.

28. The smoking article of claim 24 or 25, wherein the dispersing agent has a granular form.

29. The smoking article of claim 24 or 25, wherein the dispersing agent has a normally solid form.

30. The smoking article of claim 24 or 25, including a mouthend piece for delivering flavor volatilized by the heat source to the mouth of the user of the article.

31. The smoking article of 24, wherein the heat source further includes a phase change material.

32. The smoking article of claim 24 or 31, wherein the heat source includes at least two agents capable of interacting exothermically with water.

33. The smoking article of claim 31 or 26, wherein the phase change material includes a sugar.

34. The smoking article of claim 31 or 26, wherein the phase change material includes a wax.

35. The smoking article of claim 24, 25, 31 or 26, wherein the heat source is capable of heating a portion of the tobacco to a temperature in excess of about 70° C. within 20 seconds from the time that exothermic interaction of the chemical agent with water is initiated.

36. The smoking article of claim 24, 25, 31 or 26, wherein the heat source is such that the tobacco is not heated to a temperature above about 350° C. during the life of the heat source.

37. The smoking article of claim 24, 25, 31 or 26, wherein the heat source is such that the tobacco is not heated to a temperature above about 180° C. during the life of the heat source.

38. The smoking article article of claim 31 or 26, wherein the chemical agent(s), dispersing agent and phase change material have solid forms.

39. The smoking article of claim 24, 25, 31 or 26, wherein the agent capable of interacting exothermically with water includes a metal oxide.

40. The smoking article of claim 24, wherein the agent capable of interacting exothermically with water includes calcium oxide.

41. The smoking article of claim 24, wherein the agent capable of interacting exothermically with water includes anhydrous magnesium sulfate.

42. The smoking article of claim 24, wherein the chemical agent(s) and dispersing agent have solid forms.

43. A smoking article which does not burn tobacco comprising:

(a) tobacco; and (b) a physically separate, non-combustion heat source for heating but not burning the tobacco, and including (i) a first chemical agent capable of interacting exothermically with a second chemical agent, and (ii) a phase change material.

44. The smoking article of claim 43, having the form of a cigarette.

45. The smoking article of claim 43 or 44, wherein the heat source further includes a third chemical agent capable of interacting exothermically with the first chemical agent.

46. The smoking article of claim 45, wherein the phase change material has a solid form prior to use of the article.

47. The smoking article of claim 43 or 44, wherein the phase change material has a solid form prior to use of the article.

48. The smoking article of claim 43 or 44, wherein the tobacco is in extruded form.

49. The smoking article of claim 43 or 44, wherein the heat source is capable of heating at least a portion of the tobacco to a temperature in excess of about 70° C. within 20 seconds from the time that exothermic interaction of the chemical agents is initiated.

50. The smoking article of claim 43 or 44, wherein the heat source is capable of heating at least a portion of the tobacco to a temperature in excess of about 70° C. within 10 seconds from the time that exothermic interaction of the chemical agents is initiated.

51. The smoking article of claim 43 or 44, wherein the heat source is such that the tobacco is not heated to a temperature above about 350° C. during the life of the heat source.

52. The smoking article of claim 43 or 44, wherein the heat source is such that the tobacco is not heated to a temperature above about 180° C. during the life of the heat source.

53. The smoking article article of claim 43 or 44, including a mouthend piece for delivering flavor volatilized by the heat source to the mouth of the user of the article.

54. The smoking article of claim 43 or 44, wherein the chemical agent(s) and phase change material have solid forms.

55. A smoking article which does not burn tobacco comprising:

(a) tobacco; and (b) a physically separate, non-combustion heat source for heating but not burning the tobacco; and including (i) at least one chemical agent capable of interacting exothermically with water, and (ii) a phase change material.

56. The smoking article of claim 55, having the form of a cigarette.

57. The smoking article of claim 55 or 56, wherein the agent capable of interacting exothermically with water includes a metal oxide.

58. The smoking article of claim 55 or 56, wherein the agent capable of interacting exothermically with water includes anhydrous magnesium sulfate.

59. The smoking article of claim 55 or 56, wherein the heat source includes at least two agents capable of interacting exothermically with water.

60. The smoking article of claim 55 or 56, wherein the tobacco is in an extruded form.

61. The smoking article of claim 55 or 56, wherein the heat source is capable of heating a portion of the tobacco to a temperature in excess of about 70° C. within 20 seconds from the time that exothermic interaction of the chemical agent with water is initiated.

62. The smoking article of claim 55 or 56, wherein the heat source is such that the tobacco is not heated to a temperature above about 350° C. during the life of the heat source.

63. The smoking article of claim 55 or 56, wherein the heat source is such that the tobacco is not heated to a temperature above about 180° C. during the life of the heat source.

64. The smoking article of claim 55 or 56, including a mouthend piece for delivering flavor volatilized by the heat source to the mouth of the user of the article.

65. A smoking article which does not burn tobacco comprising:

(a) tobacco; and (b) a physically separate, non-combustion heat source for heating but not burning the tobacco, and including:

(i) a first chemical agent, (ii) a second chemical agent capable of interacting exothermically with the first chemical agent, (iii) a third chemical agent capable of interacting exothermically with the first chemical agent;

the heat source being capable of heating at least a portion of the tobacco to at least about 70° C. within 20 seconds of initiation and to a maximum temperature of less than about 200° C.

66. The smoking article of claim 65, wherein the heat source is capable of heating at least a portion of the tobacco to at least about 70° C. within 10 seconds of initiation and to a maximum temperature of less than about 180° C.

67. The smoking article of claim 65 or 66, wherein the heat source further includes a dispersing agent.

68. A smoking article which does not burn tobacco comprising:

(a) a tobacco; and (b) a physically separate, non-combustion heat source for heating but not burning the tobacco, the heat source including at least one chemical agent capable of interacting exothermically with water; the heat source being capable of heating at least a portion of the tobacco to at least about 70° C. within 20 seconds of initiation and to a maximum temperature of less than about 200° C.

69. The smoking article of claim 68, wherein the heat source is capable of heating at least a portion of the tobacco to at least about 70° C. within 10 seconds of initiation and to a maximum temperature of less than about 180° C.

70. The smoking article of claim 68 or 69, wherein the heat source further includes a dispersing agent.

71. The smoking article of claim 67 or 70, wherein the dispersing agent has a normally solid form.

72. A smoking article which does not burn tobacco comprising:

(a) tobacco; and (b) a physically separate, non-combustion heat source for heating the tobacco, and including:

(i) first, second and third chemical agents capable of undergoing an exothermic chemical reaction with one another, (ii) a fourth agent capable of reacting with a reaction product of the exothermic chemical reaction to regenerate the second and third chemical agents for reaction with remaining first chemical agent.

73. The smoking article of claim 72, wherein the first agent is magnesium and/or aluminum, the second agent is water, the third agent is sodium hydroxide, and the fourth agent is sodium nitrite and/or sodium nitrate.

74. The smoking article of claim 52, 68, 72 or 73, including a mouthend piece for delivering flavor volatilized by the heat source to the mouth of the user of the article.

75. The smoking article of claim 73, having the form of a cigarette.

76. The smoking article of claim 73, wherein the amount of first agent and fourth agent per cigarette ranges from about 50 mg to about 300 mg.

77. A smoking article which does not burn tobacco comprising:

(a) tobacco; and (b) a physically separate, non-combustion heat source for heating but not burning the tobacco, and including () a first chemical agent capable of interacting exothermically with a second chemical agent, and (ii) a normally solid dispersing agent for the first agent.

78. The smoking article of claim 77, having the form of a cigarette.

79. The smoking article of claim 77 or 78, wherein the dispersing agent has a granular form.

80. The smoking article of claim 77 or 78, wherein the heat source is capable of heating at least a portion of the tobacco to a temperature in excess of about 70° C. within 20 second from the time that exothermical interaction of the chemical agents is initiated.

81. The smoking article of claim 77 or 78, wherein the heat source is capable of heating at least a portion of the tobacco to a temperature in excess of about 70° C. within 10 seconds from the time that exothermic interaction of the chemical agents is initiated.

82. The smoking article of claim 77 or 78, wherein the heat source is such that the tobacco is not heated to a temperature above about 350° C. during the life of the heat source.

83. The smoking article of claim 77 or 78, wherein the heat source is such that the tobacco is not heated to a temperature above about 180° C. during the life of the heat source.

84. The smoking article of claim 77 or 78, wherein the tobacco is in extruded from.

* * * * *